US009778610B2

(12) United States Patent
Hiroi

(10) Patent No.: US 9,778,610 B2
(45) Date of Patent: Oct. 3, 2017

(54) IMAGE FORMING APPARATUS

(71) Applicant: Oki Data Corporation, Tokyo (JP)

(72) Inventor: Masakazu Hiroi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/411,595

(22) Filed: Jan. 20, 2017

(65) Prior Publication Data

US 2017/0227905 A1 Aug. 10, 2017

(30) Foreign Application Priority Data

Feb. 10, 2016 (JP) ..... 2016-024070

(51) Int. Cl.
*G03G 15/00* (2006.01)

(52) U.S. Cl.
CPC ..... *G03G 15/5062* (2013.01); *G03G 15/6529* (2013.01); *G03G 15/6555* (2013.01)

(58) Field of Classification Search
None
See application file for complete search history.

(56) References Cited

U.S. PATENT DOCUMENTS 4,236,814 A * 12/1980 Tonkin ..... B41L 21/02 271/6
2008/0084443 A1* 4/2008 Yasue ..... B41J 13/0009 347/16
2015/0338808 A1* 11/2015 Ishihara ..... B65H 85/00 399/401
2016/0370748 A1* 12/2016 Tani ..... G03G 15/6529

FOREIGN PATENT DOCUMENTS

JP H11-109687 A 4/1999

* cited by examiner

*Primary Examiner* — W B Perkey
(74) *Attorney, Agent, or Firm* — Muncy, Geissler, Olds & Lowe, P.C.

(57) ABSTRACT

An image forming apparatus includes a carrying part that carries media, a supply part that forwards the media to the carrying part piece by piece, wherein when a preceding medium is detected to have been fed to the carrying part, a succeeding medium is next fed to the carrying part, and a carrying controller that stops the preceding medium at a stop position of the media before the preceding medium is carried to the image forming process. The carrying controller obtains a medium length of the preceding medium in the carrying path, and changes the stop position of the preceding medium based on the medium length such that the trailing edge of the preceding medium is maintained distant from the leading edge of the succeeding medium while the preceding medium stops at the stop position.

10 Claims, 7 Drawing Sheets

IMAGE FORMING APPARATUS

CROSS REFERENCE TO RELATED APPLICATION

This application claims priority under 35 USC 119 to Japanese Patent Application No. 2016-024070 filed on Feb. 10, 2016 original document, the entire contents which are incorporated herein by reference.

TECHNICAL FIELD

This invention relates to an image forming apparatus comprising a sheet feeding part that feeds a medium.

BACKGROUND

Among the conventional image forming apparatuses, there are ones that detect the length of a medium in the medium carrying direction and carries an irregular-size medium securely at a high speed (e.g., see Patent Document 1).

RELATED ART

[Patent Doc. 1] JP Laid-Open Patent Publication H11-109687

However, in the conventional technology, if a feeder part as a supply part is installed that forwards a medium to a multipurpose tray (below, called "MPT") as a feeding part, and an irregular-size medium is forwarded to the MPT from the feeder part, there is a problem depending on the size of the medium that the leading edge part of a succeeding medium interferes with the trailing edge of a preceding medium, which obstructs the carriage of the succeeding medium and prevents the succeeding medium from being carried to a predetermined position, and afterwards when the succeeding medium is carried, the succeeding medium cannot be detected by a medium detection sensor within predetermined time, which can cause a misdetection that jamming occurred to the succeeding medium. The objective of this invention is to solve such a problem by suppressing the misdetection of jamming of the succeeding medium.

SUMMARY

An image forming apparatus for forming images on media through an image forming operation disclosed in the application includes a carrying part that carries the media along a carrying path for the image forming operation, each of the media has a leading edge at a downstream and a trailing edge at an upstream in the carrying path, a supply part that is located at an upstream in the carrying part and forwards the media to the carrying part piece by piece, wherein when a preceding medium, which is one of the media, is detected to have been fed to the carrying part, a succeeding medium, which is another one of the media, is next fed to the carrying part, and a carrying controller that stops the preceding medium at a stop position of the media before the preceding medium is carried to the image forming process, the stop position being defined as a position where the leading edge of the media is stopped. The carrying controller obtains a medium length of the preceding medium in the carrying path, and changes the stop position of the preceding medium based on the medium length such that the trailing edge of the preceding medium is maintained distant from the leading edge of the succeeding medium while the preceding medium stops at the stop position.

This invention made in this manner allows obtaining the effect that the misdetection of jamming of the succeeding medium can be suppressed.

DETAILED DESCRIPTION OF THE EMBODIMENT(S)

Below, embodiments of the image forming apparatus by this invention are explained referring to drawings.

Embodiment 1

Figure 1:
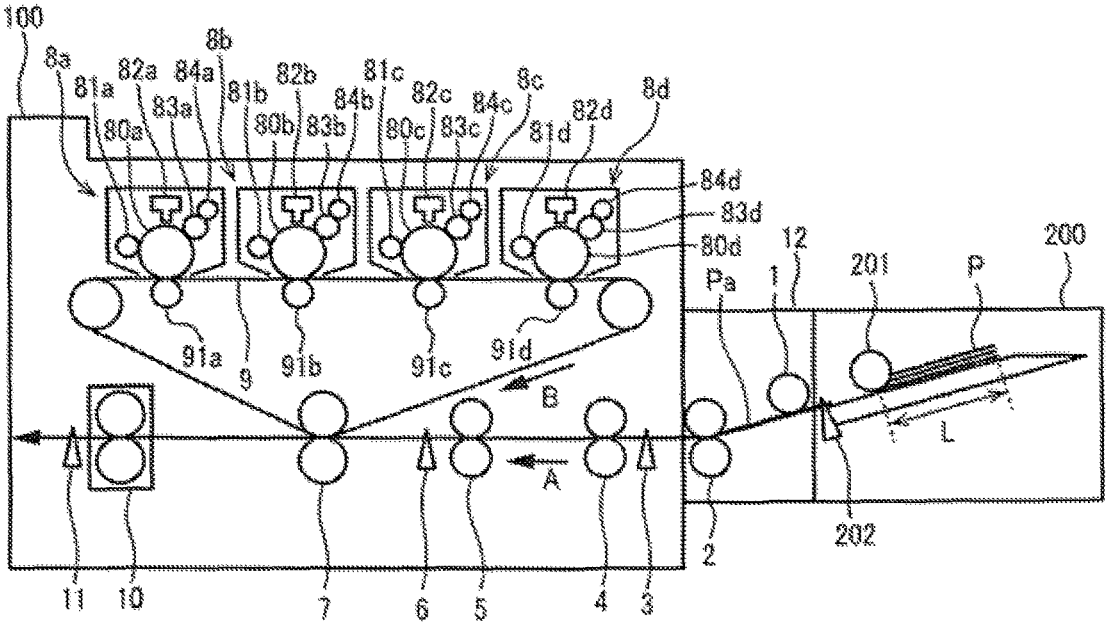
FIG. 1 is a schematic side cross-sectional view showing the configuration of an image forming apparatus in the first embodiment.

FIG. 1 is a schematic side cross-sectional view showing the configuration of an image forming apparatus in the first embodiment. In FIG. 1, the image forming apparatus 100 is a color printer, for example, that carries a medium and forms toner images on the medium. This image forming apparatus 100 comprises a multipurpose tray (MPT) 12, an entrance sensor 3, a registration roller pair 4, a timing roller 5, a writing sensor 6, a secondary transfer roller 7, image forming parts 8, an image carrying belt 9, a fuser 10, an exit sensor 11, and a feeder 200.

The MPT 12 as a sheet feeding part comprises a sheet feeding roller 1 and a separation roller 2, and feeds the medium supplied to a placing table to a carrying part formed with the registration roller pair 4 and the timing roller 5. By rotating, the sheet feeding roller 1 feeds the medium supplied to the placing table of the MPT 12 in the medium carrying direction indicated by an arrow A in the figure. The separation roller 2 separates one sheet at a time from the medium supplied by the sheet feeding roller 1 and carries it in the medium carrying direction.

The entrance sensor 3 detects the medium carried by the separation roller 2. The registration roller pair 4 as a carrying part corrects skew of the medium by contacting with the leading edge of the medium carried by the separation roller 2 and nip-carries the medium. The timing roller 5 as a carrying part nip-carries the medium carried by the registration roller pair 4. The writing sensor 6 as the second detection part is disposed in the downstream side of the timing roller 5 in the medium carrying direction, and detects the leading edge of the medium carried by the timing roller 5 to detect the timing to form images (image formation start time) in the image forming parts 8.

The image forming parts 8 (8*a*, 8*b*, 8*c*, and 8*d*) form images of toners as developers of respective colors. For example, the image forming part 8*a* forms a toner image as a cyan developer image, the image forming part 8*b* a magenta toner image, the image forming part 8*c* a yellow toner image, and the image forming part 8*d* a black toner image.

Each of the image forming parts 8 (8*a*, 8*b*, 8*c*, and 8*d*) is configured of an image drum 80 (80*a*, 80*b*, 80*c*, or 80*d*) as a photosensitive drum, a charging part 81 (81*a*, 81*b*, 81*c*, or 81*d*) that uniformly charges the surface of the image drum 80 (80*a*, 80*b*, 80*c*, or 80*d*), an exposure part 82 (82*a*, 82*b*, 82*c*, or 82*d*) that exposes the charged image drum 80 (80*a*, 80*b*, 80*c*, or 80*d*) to form an electrostatic latent image, a development roller 83 (83*a*, 83*b*, 83*c*, or 83*d*) that develops with the developer the electrostatic latent image formed on the image drum 80 (80*a*, 80*b*, 80*c*, or 80*d*), and a supply roller 84 (84*a*, 84*b*, 84*c*, or 84*d*) that supplies the developer to the development roller 83 (83*a*, 83*b*, 83*c*, or 83*d*).

The image carrying belt 9 is an endless rotatable belt that rotates in the carrying direction indicated by an arrow B in the figure and carries the toner images formed in the image forming parts 8 (8*a*, 8*b*, 8*c*, and 8*d*). Arranged opposing the image drums 80 (80*a*, 80*b*, 80*c*, and 80*d*) of the image forming parts 8 (8*a*, 8*b*, 8*c*, and 8*d*) through the image carrying belt 9 are primary transfer parts 91 (91*a*, 91*b*, 91*c*, and 91*d*), respectively.

These primary transfer parts 91 (91*a*, 91*b*, 91*c*, and 91*d*) transfer the toner images (developer images) formed on the image drums 80 (80*a*, 80*b*, 80*c*, and 80*d*) of the image forming parts 8 (8*a*, 8*b*, 8*c*, and 8*d*) to the image carrying belt 9 as an intermediate transfer belt. The secondary transfer roller 7 transfers the toner images carried by the image carrying belt 9 to the medium carried up by the timing roller 5.

The fuser 10 fuses the toner images transferred to the medium by the secondary transfer roller 7 to the medium with heat and a pressure. The exit sensor 11 detects the medium that has the toner images fused in the fuser 10 and is carried up. The medium detected by the exit sensor 11 is carried to the outside of the apparatus and is ejected.

The feeder 200 as a supply part is detachably installed to the MPT 12 installed in the image forming apparatus 100, and sequentially supplies to the MPT 12 an irregular-size medium P (e.g., an envelope of a medium length L in the medium carrying direction indicated by the arrow A in the figure) placed on the placing table. This feeder 200 comprises a sheet feeding roller 201 and a sheet feeding sensor 202, and upon detecting by the sheet feeding sensor 202 that a forwarded preceding medium Pa is fed by the MPT 12, it forwards the succeeding medium P to the MPT 12. Also, the feeder 200 has a configuration provided with a drive source, a control circuit, etc. so as to operate independently of the image forming apparatus 100.

Because the amount of medium that can be placed on the placing table of the MPT 12 is small, when printing a large amount of medium P by the image forming apparatus 100, the feeder 200 is attached to the MPT 12, and the feeder 200 sequentially supplies the medium P placed on the placing table to the MPT 12. By rotating, the sheet feeding roller 201 carries the medium P placed on the placing table in the medium carrying direction indicated by the arrow A in the figure and forwards it to the MPT 12.

The sheet feeding sensor 202 as a first detection part detects that the trailing edge of the medium supplied to the MPT 12 is gone, that is, the preceding medium Pa forwarded to the MPT 12 was fed by the MPT 12. Upon detecting with the sheet feeding sensor 202 that the medium Pa forwarded to the MPT 12 is gone, the feeder 200 autonomously rotates the sheet feeding roller 201 and forwards the succeeding medium P to a predetermined position in the downstream side of the sheet feeding roller 1 of the MPT 12 in the medium carrying direction.

Figure 2:
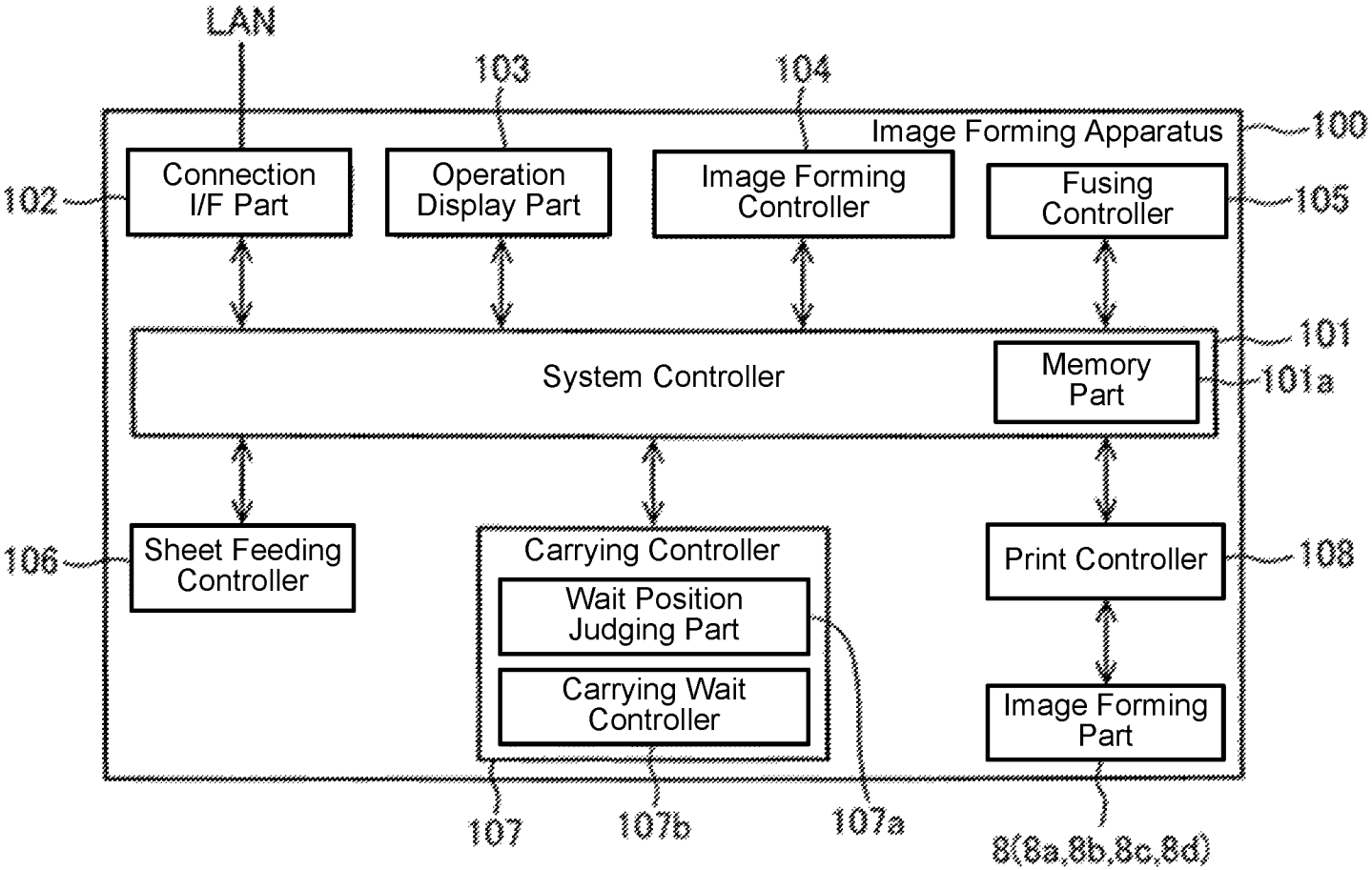
FIG. 2 is a block diagram showing the control configuration of the image forming apparatus in the first embodiment.

FIG. 2 is a block diagram showing the control configuration of the image forming apparatus in the first embodiment. In FIG. 2, the image forming apparatus 100 comprises a system controller 101, a connection I/F part 102, an operation display part 103, an image forming controller 104, a fusing controller 105, a sheet feeding controller 106, a carrying controller 107, and a print controller 108.

The system controller 101 is provided with a control means such as a CPU (Central Processing Unit) and a memory part 101*a* such as nonvolatile memory, and controls the operation of the whole image forming apparatus 100 by controlling the connection I/F part 102, the operation display part 103, the image forming controller 104, the fusing controller 105, the sheet feeding controller 106, the carrying controller 107, and the print controller 108 based on a control program stored in the memory part 101*a*. Throughout the specification, various types of controllers that are discussed may be embodied with a processor(s) and appropriate software running on the processor(s).

The connection I/F part 102 is connected to a LAN (Local Area Network) or the like, and controls communication based on TCP/IP (Transmission Control Protocol/Internet Protocol). This connection I/F part 102 receives command data that instruct printing etc. from an external device such as a host computer connected to the LAN.

The operation display part 103 is provided with a display part such as a display and an operation part such as keys and a touch panel. The system controller 101 accepts a setting input operation by a user through the operation display part 103, and stores the inputted setting information in the memory part 101*a*. The setting information is information that defines the operation of the image forming apparatus 100, and in this embodiment the setting information includes information indicating the presence/absence of the feeder 200 shown in FIG. 1.

The image forming controller 104 generates image data for printing based on the command data received by the connection I/F part 102, forms toner images on the image drums 80 in the image forming parts 8 shown in FIG. 1, and transfers the toner images to the image carrying belt 9. Also, the image forming controller 104 is provided with a HDD (hard disk drive) or the like, stores the command data received by the connection I/F part 102, and stores the image data for printing generated from the command data.

The fusing controller 105 controls the fuser 10 shown in FIG. 1 to fuse the toner images transferred to a medium with heat and a pressure to the medium. The sheet feeding controller 106 controls the sheet feeding roller 1 and the separation roller 2 of the MPT 12 shown in FIG. 1 to feed the medium placed on the MPT 12. The carrying controller 107 controls the carrying part comprising the registration roller pair 4 and the timing roller 5 shown in FIG. 1 to carry the medium fed from the MPT 12.

In order to match position and speed between the developer images primary-transferred to the image carrying belt 9 shown in FIG. 1 and the carried medium, the carrying controller 107 performs a control of pausing the medium at a stop position that is in the upstream side of the secondary transfer roller 7 as a secondary transfer part and in the downstream side of the sheet feeding roller 1 that feeds the medium and the separation roller 2 that separates the medium of the MPT 12 in the medium carrying direction, and resuming the carriage toward the secondary transfer roller 7.

The carrying controller 107 comprises a wait position judging part 107*a* and a carrying wait controller 107*b*, and performs a control of stopping the leading edge of the medium carried by the registration roller pair 4 and the timing roller 5 shown in FIG. 1 at a reference position and different positions from the reference position. The wait position judging part 107*a* as a judging part judges the necessity to change the stop position of the medium based on the medium length in the medium carrying direction of the medium forwarded from the feeder 200 shown in FIG. 1. Specifically, the wait position judging part 107*a* judges whether to change the wait position of the medium based on medium size information included in the command data.

If it is judged necessary to change the wait position of the medium, the wait position judging part 107*a* sends information on the wait position of the medium to the carrying wait controller 107*b*. Here, the medium size information is information on the size of a regular medium such as A4, A3, B4, or B5, or the size of an irregular medium such as an envelope, and from this information the medium length L in the medium carrying direction shown in FIG. 1 can be derived.

If the wait position judging part 107*a* judges it necessary to change the stop position of the medium, the carrying wait controller 107*b* as a wait position controller changes the stop position of the leading edge of the medium to the downstream side of the reference position in the medium carrying direction. Specifically, based on the information on the wait position of the medium sent from the wait position judging part 107*a*, the carrying wait controller 107*b* controls the sheet feeding roller 1 and the separation roller 2 shown in FIG. 1, and performs a carrying control of stopping the medium at the predetermined wait position.

The print controller 108 controls the fusing controller 105, the sheet feeding controller 106, the carrying controller 107, the image forming parts 8 (8*a*, 8*b*, 8*c*, and 8*d*), and the secondary transfer roller 7 shown in FIG. 1 to perform a print operation of forming and fusing toner images on the medium fed by the sheet feeding controller 106.

Figure 3:
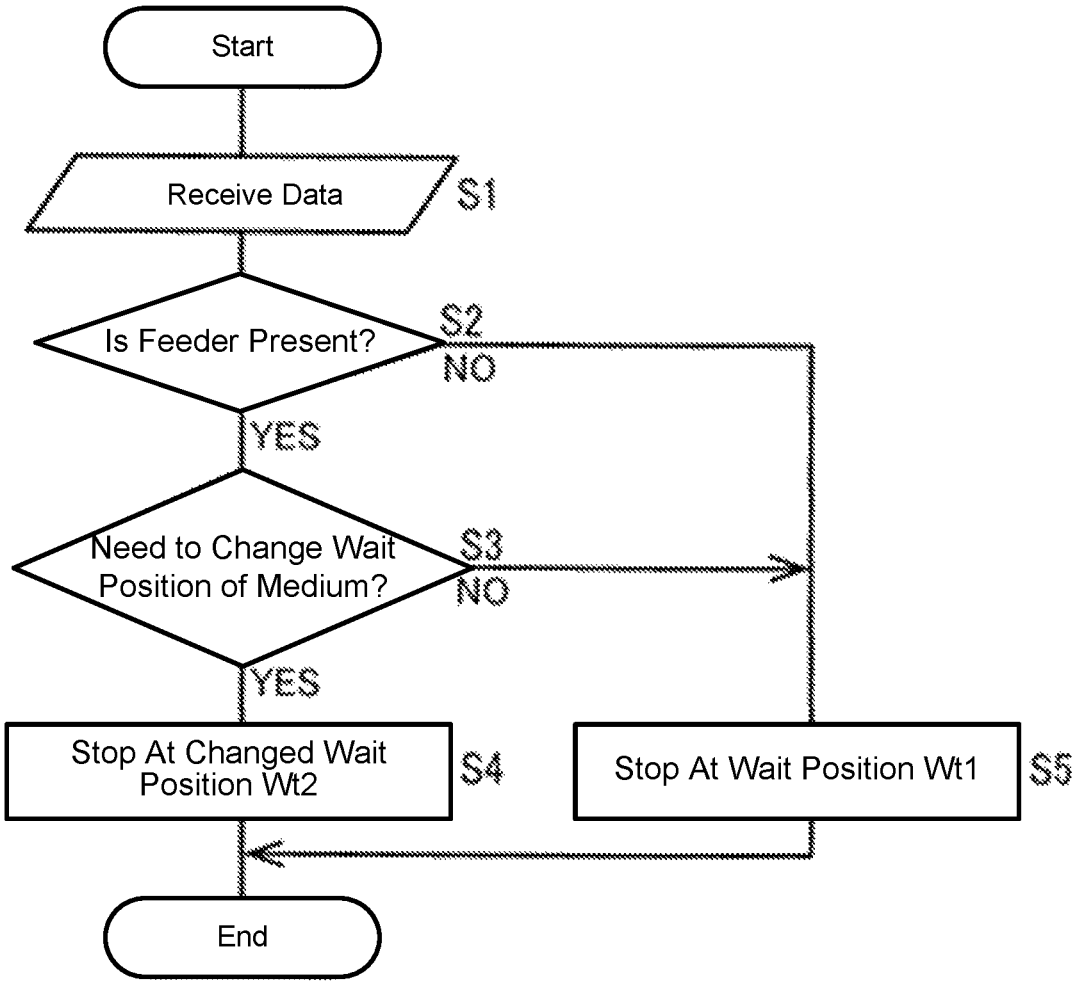
FIG. 3 is a flow chart showing the flow of a sheet feeding process in the first embodiment.

The actions of the above-mentioned configuration are explained. A sheet feeding process performed by the image forming apparatus is explained following steps indicated by S in a flow chart showing the flow of the sheet feeding process in the first embodiment in FIG. 3 referring to FIGS. 1, 2, and 4A-4F. Note that FIGS. 4A-4F are explanatory diagrams for the sheet feeding process in the first embodiment, schematically expressing the sheet feeding roller 201 and the sheet feeding sensor 202 of the feeder 200, the sheet feeding roller 1 and the separation roller 2 of the MPT 12, the entrance sensor 3, the registration roller pair 4, the timing roller 5, the writing sensor 6, and the secondary transfer roller 7 shown in FIG. 1.

S1: The connection I/F part 102 of the image forming apparatus 100 receives the command data, analyzes the received command data, and if it judges that the command data are a print request, notifies the system controller 101 that the print request was received. The system controller 101 that received the notice generates print data based on print information specified in the header part of the command data, and sends to the print controller 108 a print start instruction together with the print data and the setting information read from the memory part 101*a*.

Figure 4A:
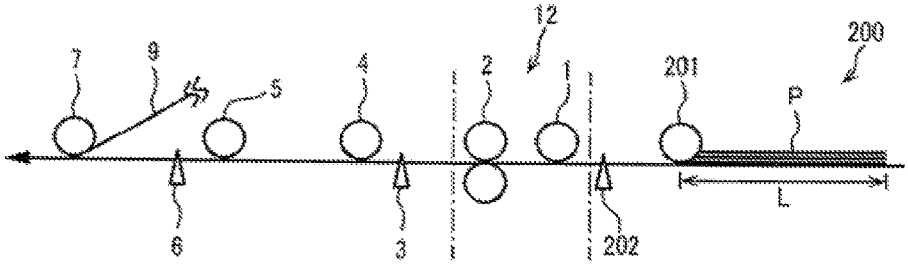
FIGS. 4A-4F are explanatory diagrams for the sheet feeding process in the first embodiment.
Figure 4B:
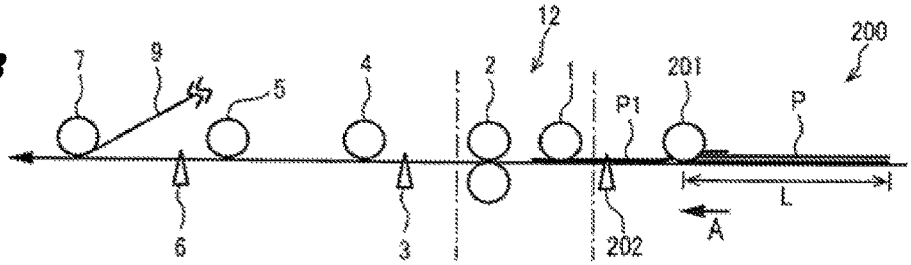

The print controller 108 that received the print start instruction sends a sheet feeding instruction to the sheet feeding controller 106, and sends the print data, the setting information, and a carrying instruction to the carrying controller 107. At this time, it is assumed that the medium P is placed on the placing table of the feeder 200 and has not been fed to the MPT 12 as shown in FIG. 4A. Because the sheet feeding sensor 202 has not detected the medium, the feeder 200 rotates the sheet feeding roller 201 to forward the medium P of the medium length L in the medium carrying direction indicated by the arrow A in the figure and feed it to the MPT 12 as shown in FIG. 4B.

The sheet feeding controller 106 that received the sheet feeding instruction rotates the sheet feeding roller 1 and the separation roller 2 to start feeding the preceding medium P1 fed from the feeder 200. Also, the carrying controller 107 that received the carrying instruction together with the print data and the setting information rotates the registration roller pair 4 and the timing roller 5 to start carrying the medium.

S2: At this time, the carrying controller 107 judges the presence/absence of the feeder 200 based on the setting information. If it is judged that the feeder 200 is present, that is, it is attached to the MPT 12, the process is changed over to S3, and if it is judged that the feeder 200 is absent, that is, it is not attached to the MPT 12, the process is changed over to S5. Note that if the feeder 200 is not attached to the MPT 12, that is, the medium placed on the placing table of the MPT 12 is fed, because the medium is not supplied from the feeder 200 to the MPT 12, the leading edge of the succeeding medium supplied from the feeder 200 will not interfere with the trailing edge of the preceding medium. Therefore, the succeeding medium will not be misjudged as jammed.

S3: The carrying controller 107 that judged that the feeder 200 was present sends the print data to the wait position judging part 107*a*, and judges the necessity to change the wait position of the leading edge of the medium based on the medium size information included in the print data. If it is judged necessary, the process is changed over to S4, and if it is judged unnecessary, the process is changed over to S5.

Here, the judgment on the necessity to change the wait position of the leading edge of the medium is made according to whether the medium length L in the carrying direction of the medium is shorter (smaller) than a threshold value C based on the medium size information, and if it is shorter, it is judged necessary to change the wait position of the leading edge of the medium. Note that the medium length L is the length in the carrying direction of the medium forwarded from the feeder 200, and that the threshold value C is a value included in the setting information stored in the memory part 101*a*.

Figure 4C:
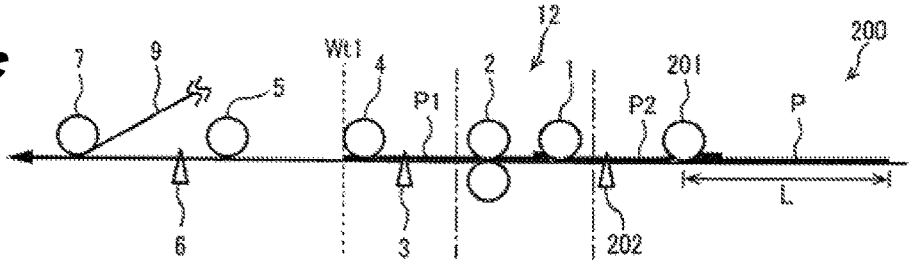

If the medium length L of the preceding medium P1 is shorter than the threshold value C, as shown in FIG. 4C, when the leading edge part of the preceding medium P1 is stopped at a wait position Wt1 that is the reference position, the leading edge of a succeeding medium P2, that is the medium fed next, interferes with the preceding medium P1, which obstructs the carriage of the succeeding medium P2, thereby it is possible to misdetect a delay in carrying the succeeding medium P2 and misjudge it as jamming of the medium when starting to feed the succeeding medium P2.

Note that the wait position Wt1 is a predetermined medium stop position assuming as the reference the medium length L of a medium (e.g., A4 size) used as the standard in the image forming apparatus 100, which is a preferable wait position for forming toner images on the medium by matching the timing between the rotation of the image carrying belt 9 shown in FIG. 1 and the carriage of the medium.

In order to suppress the misjudgment of jamming of the medium, if the medium length L of the preceding medium P1 is shorter than the threshold value C, the stop position of the leading edge part of the medium P1 is changed to a changed wait position Wt2 that is in the downstream side of the predetermined wait position Wt1 in the medium carrying direction. Therefore, the process is changed over to S4. Note that the distance D between the wait position Wt1 and the changed wait position Wt2 is assumed to be included in the setting information as a predetermined distance.

Figure 4D:
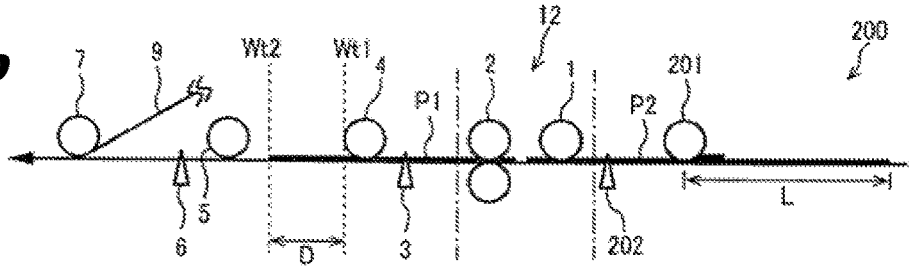

S4: If the wait position judging part 107*a* judges it necessary to change the wait position of the leading edge of the medium in S3, as shown in FIG. 4D, the carrying wait controller 107*b* stops the carriage of the preceding medium P1 so that the stop position of the leading edge part of the preceding medium P1 becomes the changed wait position Wt2 in the downstream side of the wait position Wt1 in the medium carrying direction, and the sheet feeding controller 106 stops feeding sheets, finishing this process.

S5: On the other hand, if the carrying controller 107 judges that the feeder 200 is absent in S2, or if the wait position judging part 107*a* judges it unnecessary to change the wait position of the leading edge of the medium in S3, as shown in FIG. 4C, the carrying wait controller 107*b* stops the carriage of the preceding medium P1 so that the stop position of the leading edge part of the preceding medium P1 becomes the wait position Wt1, and the sheet feeding controller 106 also stops feeding sheets, finishing this process. Note that the carrying controller 107 and the print controller 108 carry the fed medium in the timing matched with the toner images carried by the image carrying belt 9, and perform printing on the medium based on the print data.

Figure 4E:
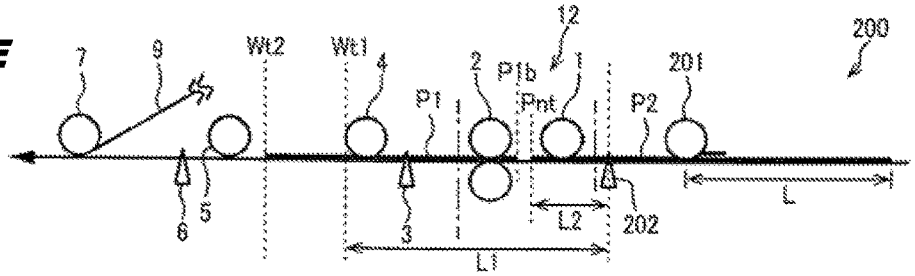

Here, the above-mentioned threshold value C and distance D are explained in detail based on FIG. 4E. In FIG. 4E, denoting the distance between the sheet feeding sensor 202 and the wait position Wt1 as L1, the threshold value C is set to the distance L1. The wait position Wt1 is a predetermined position where the medium is let wait in order to carry the fed medium in the timing matched with the toner images carried by the image carrying belt 9. In this embodiment, if the length of the preceding medium P1 in the carrying direction (medium length L) derived based on the medium size information included in the print data is shorter than the distance L1, because the succeeding medium P2 is fed by the feeder 200, the stop position of the leading edge part of the preceding medium P1 is changed to the changed wait position Wt2 that is in the downstream side of the wait position Wt1 in the medium carrying direction. Note that if the length of the preceding medium P1 in the carrying direction (medium length L) is larger than the distance L1, the succeeding medium P2 is not fed by the feeder 200. That is because the trailing edge of the preceding medium P1 is present on the sheet feeding sensor 202 when the leading edge of the medium P1 stops at the wait position Wt1.

Also, in FIG. 4E, denoting the stop position of the leading edge of the succeeding medium P2 forwarded by the feeder 200 as a succeeding medium leading edge position Pnt, and the distance between the sheet feeding sensor 202 and the succeeding medium leading edge position Pnt as L2, a distance D is set to the distance L2. In this manner, the judgment on the necessity to change the wait position of the leading edge of the preceding medium P1 is made according to whether the length of the preceding medium P1 in the carrying direction (medium length L) is shorter than the distance L1 between the sheet feeding sensor 202 of the feeder 200 and the wait position Wt1, and if it is shorter, it is judged necessary to change the wait position of the leading edge of the medium.

Figure 4F:
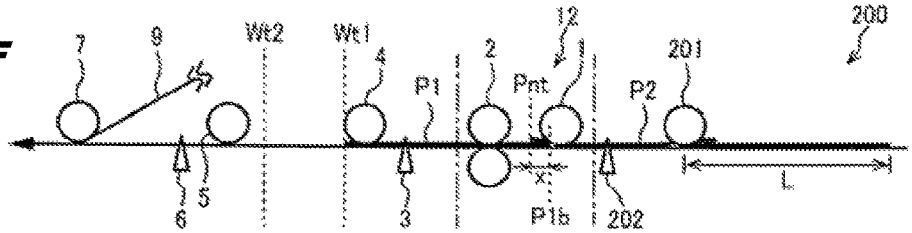

If the medium length L is shorter than the distance L1, as shown in FIG. 4F, when the leading edge part of the preceding medium P1 is stopped at the wait position Wt1, the trailing edge position P1*b* of the preceding medium P1 becomes located in the upstream side, by a distance X in the medium carrying direction, of the leading edge position Pnt of the succeeding medium P2, that is the medium fed next, thereby it is possible to misdetect the occurrence of a delay by the distance X in carrying the succeeding medium P2 when starting to feed the succeeding medium P2 and misjudge it as jamming of the medium. That is because, when the medium length L is shorter than the distance L1 and longer than (L1−L2), the trailing edge of the preceding medium P1 passes over the sheet feeding sensor 202, causing the succeeding medium to be carried up to the position Pnt. Since the position Pnt is at a downstream side from the position P1*b*, the preceding and the succeeding media are overlapped in that area (Pnt−P1*b*), see x-area in FIG. 4F. In the invention, to avoid such an overlap, when the medium length is shorter than L1, the wait position is changed from Wt1 to Wt2 which is further downstream.

In this embodiment, in order to suppress the misjudgment of jamming of the medium, if it is judged necessary to change the wait position by the wait position judging part 107*a*, as shown in FIG. 4E, the carrying wait controller 107*b* stops the carriage of the preceding medium P1 so that the stop position of the leading edge part of the preceding medium P1 becomes the changed wait position Wt2 in the downstream side of the wait position Wt1 in the medium carrying direction (the change amount in the stop position is the distance D (distance L2)).

In this manner, in this embodiment, if it is judged necessary to change the wait position by the wait position judging part 107*a*, by the carrying wait controller 107*b* stopping the carriage of the preceding medium P1 so that the stop position of the leading edge part of the preceding medium P1 becomes the changed wait position Wt2 in the downstream side of the wait position Wt1 in the medium carrying direction, the trailing edge position P1*b* of the preceding medium P1 becomes located in the downstream side of the leading edge position Pnt of the succeeding medium P2 in the medium carrying direction, a space is maintained between the trailing edge of the preceding medium P1 and the leading edge of the succeeding medium P2, making it possible to suppress the misjudgment of jamming of the medium.

As explained above, in the first embodiment, by stopping the preceding medium so that the stop position of the leading edge part of the preceding medium becomes the changed wait position in the downstream side of the wait position in the medium carrying direction, a space is maintained between the trailing edge of the preceding medium and the leading edge of the succeeding medium, which allows obtaining the effect that the misjudgment of jamming of the medium can be suppressed without affecting the carriage of the succeeding medium.

Embodiment 2

The configuration of the second embodiment is made by providing the control configuration of the first embodiment with a leading edge position calculation part that calculates the position of the leading edge of a medium based on the medium size information. The configuration of the second embodiment is explained based on a block diagram showing the control configuration of an image forming apparatus in the second embodiment in FIG. 5. Note that the same parts as in the first embodiment mentioned above are given the same codes, and their explanations are omitted.

Figure 5:
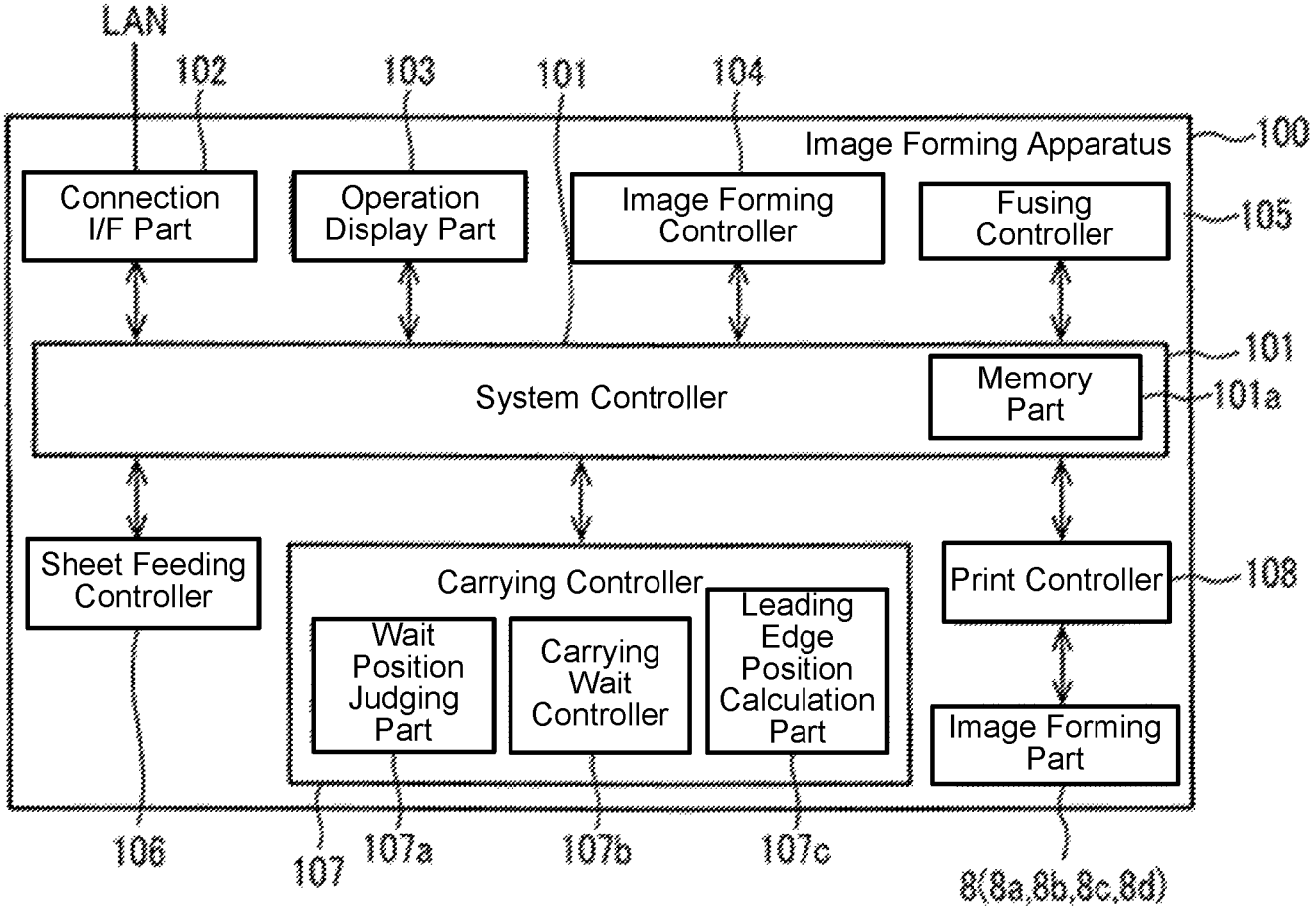
FIG. 5 is a block diagram showing the control configuration of an image forming apparatus in the second embodiment.

In FIG. 5, a carrying controller 107 comprises a wait position judging part 107*a*, a carrying wait controller 107*b*, and a leading edge position calculation part 107*c*. The leading edge position calculation part 107*c* calculates the wait position of the leading edge of the medium based on the medium size information included in command data received by a connection I/F part 102.

Figure 6:
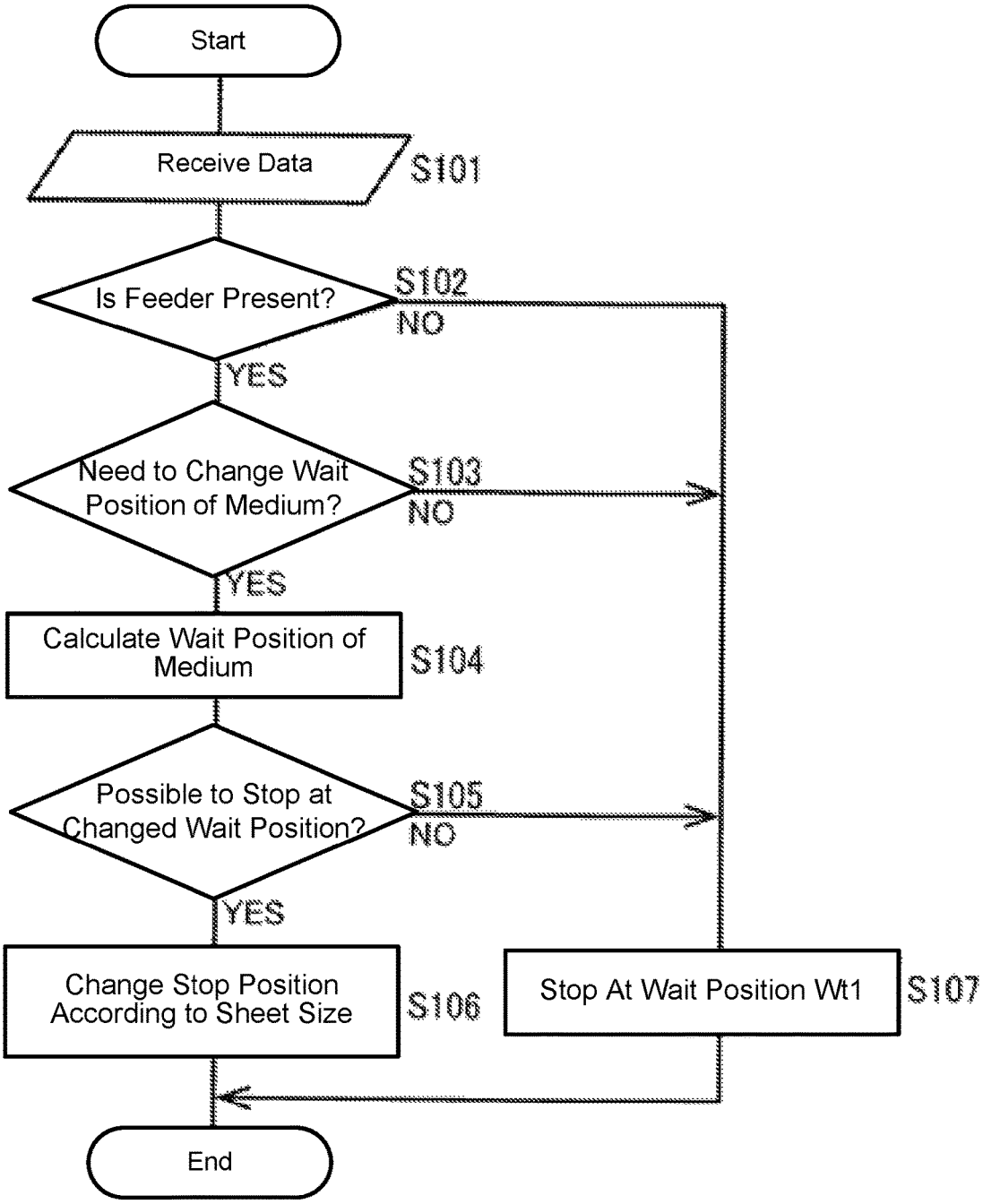
FIG. 6 is a flow chart showing the flow of a sheet feeding process in the second embodiment.
Figure 7A:
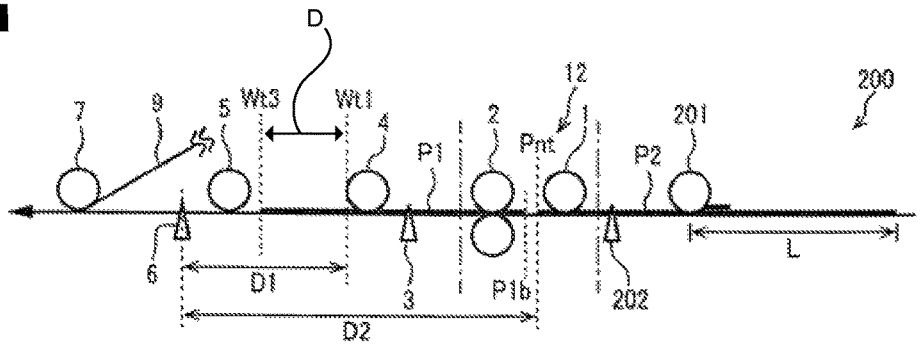
FIGS. 7A and 7B are explanatory diagrams for the sheet feeding process in the second embodiment.
Figure 7B:
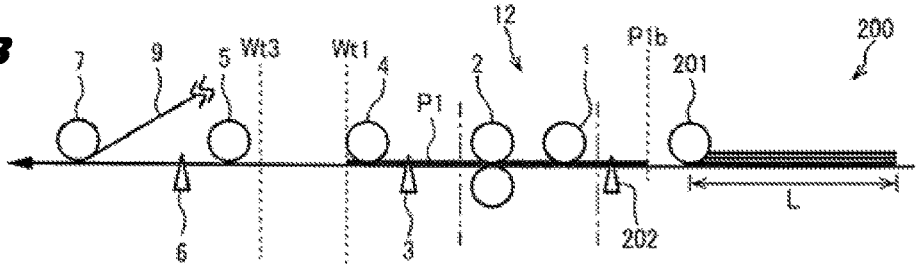

The actions of the above-mentioned configuration are explained. A sheet feeding process performed by the image forming apparatus is explained following steps indicated by S in a flow chart showing the flow of the sheet feeding process in the second embodiment in FIG. 6 referring to FIGS. 1, 5, 7A, and 7B. Note that FIGS. 7A and 7B are explanatory diagrams for the sheet feeding process in the second embodiment, schematically expressing a sheet feeding roller 201 and a sheet feeding sensor 202 of a feeder 200, a sheet feeding roller 1 and a separation roller 2 of a MPT 12, an entrance sensor 3, a registration roller pair 4, a timing roller 5, a writing sensor 6, and a secondary transfer roller 7 shown in FIG. 1

S101: Because this is the same process as Si shown in FIG. 3, its explanation is omitted. S102: The carrying controller 107 judges the presence/absence of the feeder 200 based on the setting information. If it is judged that the feeder 200 is present, that is, it is attached to the MPT 12, the process is changed over to S103, and if it is judged that the feeder 200 is absent, that is, it is not attached to the MPT 12, the process is changed over to S107.

S103: The carrying controller 107 that judged that the feeder 200 was present sends print data to the wait position judging part 107*a*, which judges the necessity to change the wait position of the leading edge of the medium based on the medium size information included in the print data. If it is judged necessary, the process is changed over to S104, and if it is judged unnecessary, the process is changed over to S107. Here, the judgment on the necessity to change the wait position of the leading edge of the medium is made according to whether the medium length L in the carrying direction of the medium is shorter than a threshold value C based on the medium size information in the same manner as in the first embodiment, and if it is shorter, it is judged necessary to change the wait position of the leading edge of the medium. Note that the threshold value C is a value included in the setting information stored in a memory part 101*a*.

S104: In S103, if the wait position judging part 107*a* judges it necessary to change the wait position of the leading edge of the medium, the leading edge position calculation part 107*c* calculates the wait position of the leading edge of the medium based on the medium size information. Here, the calculation method of the above-mentioned wait position of the medium leading edge is explained based on FIG. 7A.

In FIG. 7A, denoting the medium length of the medium P derived from the medium size information as L, the stop position of the leading edge part of the preceding medium P1 before changing it as a wait position Wt1, the distance between a writing sensor 6 and the wait position Wt1 as D1, the position of the leading edge of the succeeding medium P2 fed by the feeder 200 as a succeeding medium leading edge position Pnt, and the distance between the writing sensor 6 and the succeeding medium leading edge position Pnt as D2, the changed wait position Wt3 of the medium leading edge is calculated as a position away from the wait position Wt1 by (the medium length L+the distance D1−the distance D2) in the medium carrying direction.

In this manner, the leading edge position calculation part 107*c* adopts (the medium length L+the distance D1−the distance D2) as the amount to change the stop position of the leading edge of the preceding medium P1. Note that the distance D1 and the distance D2 are values included in the setting information stored in the memory part 101*a*. Also, the writing sensor 6 is disposed in the downstream side of the wait position Wt1 in the medium carrying direction.

S105: Based on the changed wait position Wt3 of the medium leading edge calculated by the leading edge position calculation part 107*c*, the wait position judging part 107*a* judges whether it is possible to stop the leading edge of the preceding medium P1 at the changed wait position Wt3 of the medium leading edge. If it is judged possible, the process is changed over to S106, and if it is judged impossible, the process is changed over to S107.

Here, the judgment on the possibility to stop the leading edge of the preceding medium P1 at the changed wait position Wt3 of the medium leading edge is made based on whether the changed wait position Wt3 of the medium leading edge is located between the writing sensor 6 and the wait position Wt1 that is the unchanged stop position of the leading edge part of the preceding medium P1 in the upstream side of the writing sensor 6 in the medium carrying direction, that is, whether the changed wait position Wt3 of the medium leading edge exceeds the writing sensor 6.

If the changed wait position Wt3 of the medium leading edge is located between the writing sensor 6 and the wait position Wt1 that is the unchanged stop position of the leading edge part of the preceding medium P1 in the upstream side of the writing sensor 6 in the medium carrying direction, that is, if the changed wait position Wt3 of the medium leading edge does not exceed the writing sensor 6 (if the medium length L<the distance D2), it is judged possible to stop the leading edge of the preceding medium P1 at the changed wait position Wt3 of the medium leading edge.

On the other hand, if the changed wait position Wt3 of the medium leading edge is not located between the writing sensor 6 and the wait position Wt1 that is the unchanged stop position of the leading edge part of the preceding medium P1 in the upstream side of the writing sensor 6 in the medium carrying direction, that is, if the changed wait position Wt3 of the medium leading edge exceeds the writing sensor 6 (if the medium length L≥the distance D2), it is judged impossible to stop the leading edge of the preceding medium P1 at the changed wait position Wt3 of the medium leading edge. This is because the timing to transfer toner images carried by an image carrying belt 9 to the medium cannot be secured if the changed wait position Wt3 of the medium leading edge exceeds the writing sensor 6.

S106: If the wait position judging part 107*a* judges it possible to stop the leading edge of the preceding medium P1 at the changed wait position Wt3 of the medium leading edge, as shown in FIG. 7A, the carrying wait controller 107*b* stops the carriage of the preceding medium P1 so that the stop position of the leading edge part of the preceding medium P1 becomes the changed wait position Wt3 in the downstream side of the wait position Wt1 in the medium carrying direction, finishing this process. Namely, at S106, the stop position is changed according to the sheet size.

S107: On the other hand, if the carrying controller 107 judges that the feeder 200 is absent in S102, if the wait position judging part 107*a* judges it unnecessary to change the wait position of the leading edge of the medium in S103, or if the wait position judging part 107*a* judges it impossible to stop the leading edge of the preceding medium P1 at the changed wait position Wt3 of the medium leading edge in S105, as shown in FIG. 7B, the carrying wait controller 107*b* stops the carriage of the preceding medium P1 so that the stop position of the leading edge part of the preceding medium P1 becomes the wait position Wt1, and a sheet feeding controller 106 also stops feeding sheets, finishing this process.

Note that the carrying controller 107 and the print controller 108 carry the fed medium in the timing matched with the toner images carried by the image carrying belt 9, and perform printing on the medium based on the print data. In this embodiment, in order to suppress the misjudgment of jamming of the medium, as shown in FIG. 7A, the carrying wait controller 107*b* stops the carriage of the preceding medium P1 so that the stop position of the leading edge part of the preceding medium P1 becomes the changed wait position Wt3 in the downstream side of the wait position Wt1 in the medium carrying direction.

In this manner, in this embodiment, by the carrying wait controller 107*b* stopping the carriage of the preceding medium P1 so that the stop position of the leading edge part of the preceding medium P1 becomes the changed wait position Wt3 in the downstream side of the wait position Wt1 in the medium carrying direction, the trailing edge position P1*b* of the preceding medium P1 becomes located in the downstream side of the leading edge position Pnt of the succeeding medium P2 in the medium carrying direction, and a space is maintained between the preceding medium P1 and the succeeding medium P2, which allows suppressing the misjudgment of jamming of the medium. Also, by having the leading edge position calculation part 107*c* calculate the changed wait position Wt3 based on the medium size information, even if the medium length L of the medium P placed on the feeder 200 is changed, the misjudgment of jamming of the medium can be suppressed.

As explained above, obtained in the second embodiment in addition to the effect of the first embodiment is the effect that the misjudgment of jamming of the medium can be suppressed even if the medium length of the medium placed on the feeder 200 is changed. Note that although explanations in the first embodiment and the second embodiment were given assuming that the image forming apparatus was a color printer, it is not limited to it but can be a monochrome printer, a copier, a facsimile machine, a multifunction peripheral (MFP), or the like. Also, although the explanations were given assuming that the image forming apparatus was an intermediate transfer type printer, it can be a direct transfer type printer or the like.

In this embodiment, based on the medium size information included in the print data, the size of the print medium was recognized. Otherwise, by having a print panel or the like display a device menu, and the user designate a print medium size according to this display, the size can be specified based on this designation.

What is claimed is:

1. An image forming apparatus for forming images on media through an image forming operation, comprising a carrying part that carries the media along a carrying path for the image forming operation, each of the media has a leading edge at a downstream and a trailing edge at an upstream in the carrying path, a supply part that is located at an upstream in the carrying part and forwards the media to the carrying part piece by piece, wherein when a preceding medium, which is one of the media, is detected to have been fed to the carrying part, a succeeding medium, which is another one of the media, is next fed to the carrying part, and a carrying controller that stops the preceding medium at a stop position of the media before the preceding medium is carried to the image forming process, the stop position being defined as a position where the leading edge of the media is stopped, wherein the carrying controller obtains a medium length of the preceding medium in the carrying path, and changes the stop position of the preceding medium based on the medium length such that the trailing edge of the preceding medium is maintained distant from the leading edge of the succeeding medium while the preceding medium stops at the stop position.

2. The image forming apparatus according to claim 1, wherein the medium length is embedded in print data that is used for the image forming operation, and the carrying controller obtains the medium length from the print data.

3. The image forming apparatus according to claim 1, wherein the carrying controller switches the stop position of the preceding medium between a reference position and a changed position, the reference position being defined as a position where the preceding medium is expected to normally stop, and the changed position being defined different from the reference position and as a position at the downstream from the reference position, and the carrying controller further comprises a judging part that judges a necessity to change the stop position of the preceding medium based on the medium length, and a wait position controller that changes the stop position from the reference position to the changed position when the judging part judges it necessary to change the stop position of the preceding medium.

4. The image forming apparatus according to claim 3, wherein the judging part judges it necessary to switch the stop position when the medium length is smaller than a threshold value.

5. The image forming apparatus according to claim 4, wherein the supply part comprises a detection part that detects if the trailing edge of the medium passes, and the threshold value is equal to a distance between the detection part and the reference position in the carrying path.

6. The image forming apparatus according to claim 5, wherein a distance between the reference position and the changed position in the carrying path is defined as a change amount, the wait position controller determines that the change amount is equal to a distance between a stop position of the leading edge of the succeeding medium supplied from the supply part and the detection part.

7. The image forming apparatus according to claim 5, further comprising:

another detection part that is disposed in the downstream from the reference position in the carrying path and detects a start time of the image forming operation, wherein the detection part is defined as a first detection part and the another detection part is defined as a second detection part, and the change amount satisfies $$D=(L+D1-D2),$$

wherein

L means the medium length,

D1 means a distance between the reference position and the second detection part D2 means a distance between the stop position of the leading edge of the succeeding medium supplied by the supply part and the second detection part.

8. The image forming apparatus according to claim 7, wherein the wait position controller stops the leading edge of the preceding medium at the reference position if the medium length L≥the distance D2, and stops the leading edge of the preceding medium at the changed position that is distant by the change amount in the downstream from the reference position if the medium length L<the distance D2.

9. The image forming apparatus according to claim 1, wherein the medium length is derived from a medium size information that is included in print data.

10. The image forming apparatus according to claim 1, further comprising:

a image forming part that forms a developer image on the media with a developer, wherein the carrying controller adjusts a position of the developer image and a position of the media by controls of pausing the media at the stop position and afterwards resuming to carry the media.

* * * * *